US005630713A

United States Patent [19]

Shver et al.

[11] Patent Number: 5,630,713

[45] Date of Patent: May 20, 1997

[54] ROTARY BURNER

[75] Inventors: Val Shver, Alpharetta, Ga.; Gianni Gensini, S. Stefano Di Buia, Italy

[73] Assignees: Danieli & C. Officine Meccaniche SpA, Buttrio, Italy; Process Technology International Inc., Atlanta, Ga.

[21] Appl. No.: 476,764

[22] Filed: Jun. 7, 1995

[30] Foreign Application Priority Data

Jun. 10, 1994 [IT] Italy ..... UD94A0100
Jun. 10, 1994 [IT] Italy ..... UD94A0103

[51] Int. Cl.[6] ..... F23C 5/06

[52] U.S. Cl. ..... 431/189; 431/159; 431/160

[58] Field of Search ..... 431/160, 159, 431/164, 168, 189

[56] References Cited

FOREIGN PATENT DOCUMENTS

| | | | |
|---|---|---|---|
| 8908577 | 9/1989 | Denmark . | |
| 098563 | 7/1983 | European Pat. Off. | B23K 28/00 |
| 146213 | 9/1984 | European Pat. Off. | C21C 5/52 |
| 2280501 | 7/1993 | United Kingdom | F23C 5/02 |
| WO9002907 | 9/1988 | WIPO | F23C 5/00 |
| WO89/02051 | 3/1989 | WIPO | C21B 7/16 |

OTHER PUBLICATIONS

Patent abstracts of Japan, vol. 6, No. 260 (M–180) 18 Dec. 1982 & JP–A–57 155014, Nihon Sanso KK 25 Sep. 1982, abstract.

*Primary Examiner*—Larry Jones
*Attorney, Agent, or Firm*—Antonelli, Terry, Stout & Kraus, LLP

[57] ABSTRACT

Rotary burner suitable for installation on a sidewall (11) of a furnace and for cooperating with the inside of the furnace, which comprises at least one sidewall (11) equipped with cooled panels (18), the rotary burner (10) including at least one supporting and fixture assembly (12) solidly associated with the sidewall (11) of the furnace and at least one positioning and orientation assembly (13) rotatably fitted on the axis of the supporting and fixture assembly (12), the positioning and orientation assembly (13) containing a through hole (22) in which a body (14) of the burner (10) is removably secured in a retracted position, the through hole (22) having its axis (34) downwardly inclined towards the inside of the furnace by an angle "β" between 10° and 60° in relation to the axis (33) of rotation of the positioning and orientation assembly (13), the positioning and orientation assembly (13) being able to be rotated by at least an arc of a circumference up to ±180° by the action of a drive assembly (15), the cooled panel (18) including above the rotary burner (10) at least one projection (18*a*) facing towards the inside of the furnace so as to provide protection.

18 Claims, 3 Drawing Sheets

ROTARY BURNER

BACKGROUND OF THE INVENTION

This invention concerns a rotary burner. To be more exact, the rotary burner according to the invention is applied to heating furnaces, temperature maintaining furnaces, and electric arc furnaces, whether they be melting furnaces or reduction furnaces, in the melting step or in the refining step so as to provide an additional contribution of heat.

The rotary burner according to the invention enables thermal energy to be applied to the so-called cold areas of the furnace, that is to say, to wide areas of a controlled and controllable extent, and at the same time creates a remixing of the gases, vapours and air in the environment.

Burners of the state of the art generally consist of conduits fed with a gaseous or gasified combustible substance and with an oxidizer substance such as combustion-supporting oxygen under pressure, for instance.

Depending on the positioning of these conduits, the burners can be of a type producing parallel currents, inclined currents, swirling currents or distributed currents.

The two currents, possibly pre-mixed, of a combustible substance and oxidizer meet in the vicinity of the outlet of the burner, where the combustion takes place.

Various types of burners have been disclosed but entail a series of drawbacks which have not been overcome:

a) burners with a concentrated flame, which are solidly fixed to the furnace and involve the shortcoming of providing a low thermal yield since they affect only a limited area of the furnace;

b) burners with a wide flame, which are solidly fixed to the furnace and entail the disadvantage of requiring a complex flushing of the nozzles to keep the latter clean even when the burners are quenched;

c) burners with a concentrated or wide flame, which can be removed from the furnace and be positioned as desired; their introduction into and removal from the furnace take place through an appropriate aperture; the main disadvantage is the difficulty in keeping this aperture free;

d) burners with a concentrated flame, which can be oriented by means of a cylindrical joint; this type of joint enables the burners to be oriented substantially along a straight line.

IT-UD92A000009 discloses a burner fitted to a positioning assembly cooperating with a fixture assembly solidly fitted to the shell of a melting furnace.

The positioning and fixture assemblies define a ball-and-socket joint which enables the burner to be positioned on a first plane and to be oriented on a second plane perpendicular to the first plane. This teaching does not overcome the problems of a correct, determined directing of the flame within the furnace, nor does it define the areas of the furnace to be lapped nor the parameters by which the burner can be oscillated and oriented.

A typical employment of these burners is with electric arc furnaces, whether the latter operate with indirect heating (arc melting furnaces) or direct heating (arc reduction furnaces). The burners are arranged at least on the sidewalls of the furnace.

The burners are generally placed at a given height above the level of the molten metal and are downwardly inclined towards the molten metal by a desired angle, which is generally, but is not restricted to, between 25° and 60°.

These auxiliary burners are employed mostly to heat the areas generally near the sidewalls of the furnace and in the space between the electrodes, where the action of the electrodes is delayed and less effective and therefore generally requires additional time to melt the scrap located there.

The shortcomings of the above burners do not enable an effective working of the burners to be ensured in association with such arc furnaces and therefore lead to a low yield, difficulties of working and maintenance, complexities of installation and handling and still other problems.

SUMMARY OF THE INVENTION

The present applicants have designed, tested and embodied this invention to overcome the above shortcomings of the state of the art and to achieve further advantages.

The purpose of the invention is to provide a rotary burner, which is fitted to the sidewalls of a furnace and can be oriented within a conoid that enlarges towards the inside of the furnace, so that the burner can direct the flame into a desired area of the furnace.

The rotary burner according to the invention comprises a supporting and fixture assembly consisting of at least one installation plate solidly secured to the sidewall of the furnace. This supporting and fixture assembly is installed at an aperture made in the sidewall of the furnace.

The supporting and fixture assembly has its axis of installation advantageously, but not only, substantially at a right angle to the sidewall of the furnace and therefore substantially horizontal in the most typical case of installation.

According to a variant the axis of the supporting and fixture assembly lies on a plane inclined in relation to the horizontal or vertical planes and advantageously inclined downwards.

An assembly to position and orient the rotary burner is fitted to the supporting and fixture assembly. This assembly to position and orient the burner is free to be rotated in a required and controlled manner about its own axis, which coincides substantially with the axis of the supporting and fixture assembly.

According to a variant a further assembly to orient and alter the axis of orientation of the burner is placed between the supporting and fixture assembly and the positioning and orientation assembly and enables the position of the axis of rotation of the positioning and orientation assembly to be altered in a desired and controlled manner, thus making variable in a desired manner the trajectories travelled by the outlet of the burner within the furnace.

The positioning and orientation assembly contains a through hole, within which the body of the rotary burner is fitted advantageously in such a way that it can be replaced.

The installation of the body of the burner takes place in such a manner that the axis of that body coincides substantially with the axis of the through hole.

The axis of the through hole is inclined in relation to the axis of the positioning and orientation assembly. This has the effect that the body of the burner is installed with its axis inclined in relation to the axis of the positioning and orientation assembly.

Rotation of the positioning and orientation assembly about its own axis causes the axis of the body of the burner, and therefore the flame emerging therefrom, to describe a conoid which enlarges towards the inside of the furnace.

The flame generated by the burner follows in this way a desired trajectory within the furnace, the trajectory being advantageously able to lap a great area of the furnace.

The capability to orient as desired the axis of rotation of the positioning and orientation assembly by means of the introduction of the assembly to orient and alter that axis gives the user of the furnace the ability to change the orientation and inclination of the trajectories travelled by the burner during its rotation and orientation. This change can be carried out at the beginning of the working cycle or even during the cycle itself if the necessity of such a change becomes evident.

According to the invention the burner body includes at its frontal end a mixing head equipped with at least one central pipe to feed an oxidizer such as oxygen for instance, an outer concentric annular conduit to feed a combustible substance and a further outermost annular conduit to feed an oxidizer.

This embodiment enables a flame leaving the burner to be obtained which is surrounded and enclosed by a ring of oxidizer, which forces the combustible substance to become wholly combined with the oxidizer without dispersion and without an excess of carbon in the furnace and improves the efficiency of combustion and the yield of the burner.

According to the invention the positioning and orientation assembly is equipped with a cooling system operating by circulation of a fluid.

The burner body, which too may include independent cooling means, cooperates also with the cooling system of the positioning and orientation assembly.

The burner body, as it is removably fitted to the positioning and orientation assembly, can be readily withdrawn therefrom for maintenance, replacement and/or adjustment.

The burner body is located in a position retracted within the through hole away from the inside of the furnace and is therefore sheltered from the splashes of molten metal and slag which could also create orientation problems.

Moreover, this retracted position makes possible the presence of a rotated combustion chamber where scrap is rested on the outlet edge of the furnace chamber.

This situation also enables a chamber to be embodied for pre-mixing and pre-combustion of the combustible and combustion-supporting products.

Moreover, the sidewall of the furnace at least above the burner includes a projection jutting towards the inside of the furnace so as to give protection to the burner, especially during the step of charging the furnace.

The positioning and orientation assembly cooperates with a drive assembly, which by means of a substantially circumferential thrust carries out rotation of the positioning and orientation assembly about its axis in one direction or the other and possibly also causes controlled displacement of that axis by means of actuation of the assembly that orients and alters the axis.

When the rotary burner is employed in electric arc furnaces, the trajectory imparted to the flame is advantageously not directed on the electrodes.

According to the invention the extreme lateral points of that trajectory are advantageously outside an imaginary circumference formed by the electrodes of the furnace so that the flame acts between that imaginary circumference and the sill line of the furnace.

Moreover, the flame is directed advantageously towards the cold areas of the furnace, namely the areas less effectively lapped by the action of the electrodes, such as the zones near the fourth hole of the furnace, near the slag hole, etc.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
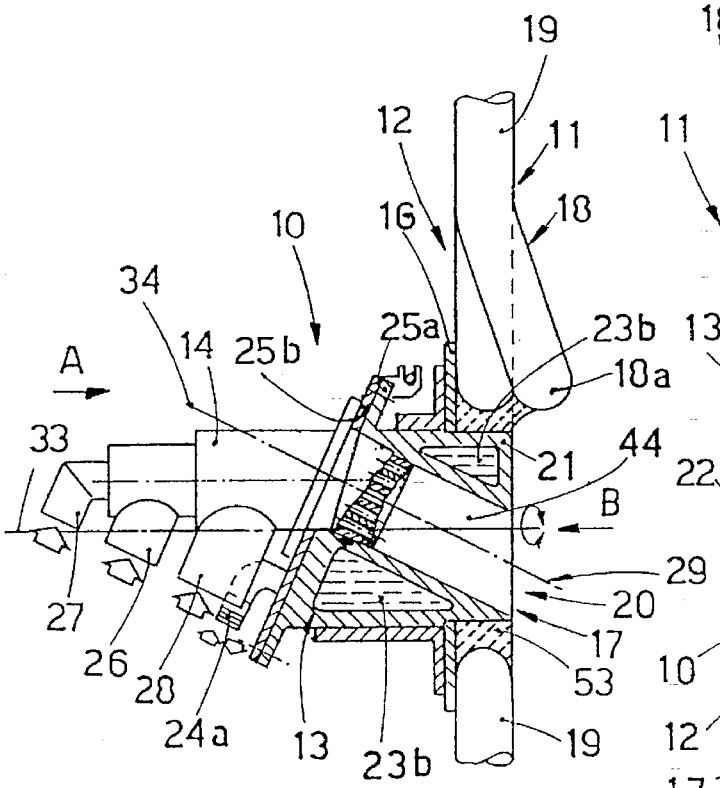
FIG. 1 is a partly cutaway side view of a rotary burner according to the invention.
Figure 3:
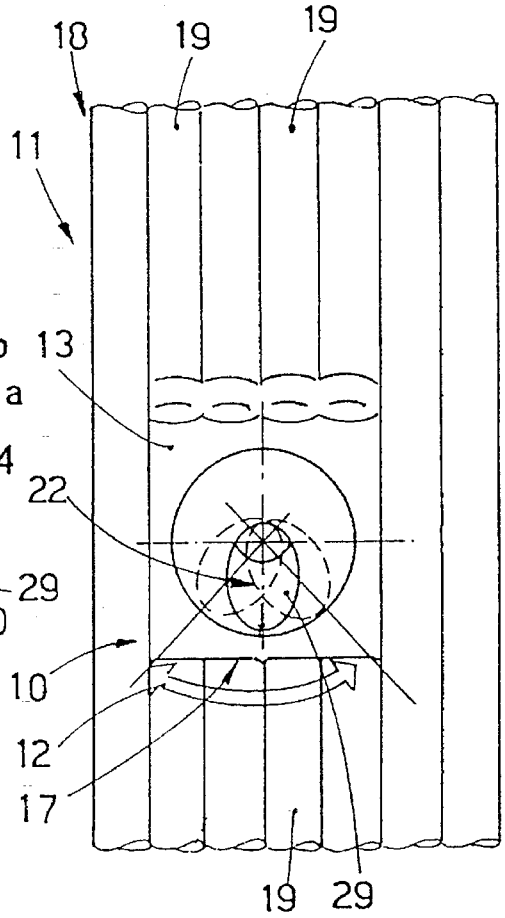
FIG. 3 is an internal side view of the rotary burner of FIG. 1 according to the arrow B.

A rotary burner 10 according to the invention is shown in FIG. 1 as fitted to a sidewall 11 of a furnace. The furnace can be a heating furnace, a temperature maintaining furnace, a melting furnace, an electric arc furnace or another type of furnace; this condition is substantially unimportant for the purposes of the invention.

The rotary burner 10 comprises a supporting and fixture assembly 12 consisting of at least one fixture plate 16 solidly fitted to the sidewall 11.

In this case, which is shown merely as an example and in which the sidewall 11 of the furnace consists of cooled panels 18 arranged vertically on the sidewall 11, the fixture plate 16 cooperates with an aperture 17 having a mating shape and provided in one of the cooled panels 18.

The cooled panel 18 consists in this case of a plurality of cooling pipes 19 in which a cooling fluid such as water, for instance, circulates.

A positioning and orientation assembly 13 is associated with the fixture plate 16.

The installation of the positioning and orientation assembly 13 on the supporting and fixture assembly 12 is performed in such a way that its substantially cylindrical end portion 21 cooperates with a substantially cylindrical seating 20 machined in the fixture plate 16.

According to the invention the task of supporting the rotary burner 10 is performed by the interface of rotation between the rotary part, or terminal cylindrical part 21, and the stationary part, or fixture plate 16.

If the rotary burner 10 is to function correctly and be moved correctly, it is necessary that this interface zone is exposed as little as possible to the dirty environment of the furnace so as to prevent, during the working, particles of dust, slag or steel blocking or at least obstructing the actuation of the rotary burner 10 within a short period.

According to the invention this is avoided by supporting the rotary part, or terminal cylindrical part 21, on the refractory 53.

The result is that all these particles of dirt penetrate into the refractory 53, which is less hard than the sidewall of the pre-combustion chamber 44, and thus these particles impair the interface of rotation 16–21 very slightly.

This enables the rotary burner 10 to function also in environments characterized by a heavy inclusion of dirtying particles without thereby producing the drawbacks arising from stoppage of the rotation.

The positioning and orientation assembly 13 is installed in that seating 20 in such a way that it can be rotated about its own axis 33, which in the example of FIG. 1 is stationary and lies substantially on a horizontal plane.

According to a variant the axis 33 of rotation of the positioning and orientation assembly 13 is inclined, downwards for instance, in relation to the horizontal plane.

According to another variant the axis 33 of rotation of the positioning and orientation assembly 13 is skewed, to the left or right, in relation to the vertical plane.

Figure 4:
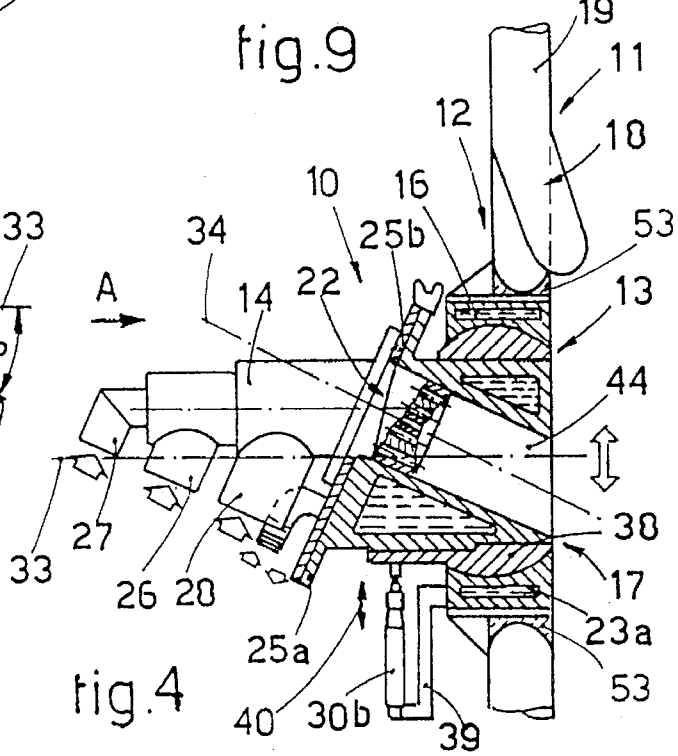
FIG. 4 shows a variant of the burner of FIG. 1.

According to the variant shown in FIG. 4 the position of the axis 33 of rotation of the positioning and orientation assembly 13 can be made variable at the beginning of the working cycle of the rotary burner 10 or even during the course of the working cycle.

In this case an assembly 38 to orient and change that axis 33 is placed between the positioning and orientation assembly 13 and the supporting and fixture assembly 12. The conformation of this assembly 38 to orient and change the axis is at least partly spherical and mates with the conformation of the fixture plate 16.

The assembly 38 to orient and change the axis 33 cooperates with a second cylinder/piston actuator **30*b* secured in this case by a support 39 to the fixture plate 16 so as to perform controlled displacement and orientation of the axis of rotation 33 of the positioning and orientation assembly 13**.

This displacement is carried out, for instance in the direction shown by an arrow 40, according to the specific requirements of the working cycle, for example according to the results found by the operators of the furnace during the working cycle itself.

In this example the fixture plate 16 contains an inner chamber **23*a*** for controlled cooling.

The positioning and orientation assembly 13 contains a through hole 22 in which the burner body 14 is removably installed, the burner body 14 having a shape that mates with the inner shape of the through hole 22.

The burner body 14 takes up only the front part of the through hole 22 so that it lies in a position protected from the furnace chamber.

For correct working of the rotary burner 10, it is in fact necessary that its components should be sheltered from sprays of slag and liquid metal.

Figure 5:
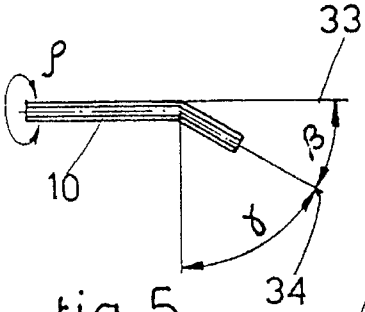
FIG. 5 shows a diagram of the installation of the burner according to the invention.

The axis 34 of the through hole 22 is inclined downwards in relation to the axis 33 of rotation of the positioning and orientation assembly 13 and forms therewith an angle "β" (FIG. 5).

According to the invention the angle "β" takes on values between 10° and 60° but advantageously between 25° and 45°.

The axis 34 of the through hole 22 is inclined downwards towards the inside of the furnace and forms with the vertical an angle "γ", which complements the angle "β" and has a value between 30° and 80° but advantageously between 45° and 65° when the axis 33 of rotation of the positioning and orientation assembly 13 lies substantially on a horizontal plane.

The positioning and orientation assembly 13 contains at least in its cylindrical end portion 21 a cooling chamber **23*b* in which a cooling fluid circulates. This cooling chamber 23*b* comprises at least one feeder intake 24*a* and one discharge outlet 24*b***, which are connected to an external cooling circuit of a known type, which is not shown here.

The cooling chamber **23*b* makes possible the cooling of the burner body 14 and therefore an improvement of the working conditions of that body 14 even where the latter 14 does not possess independent cooling means. This situation enables a burner body 14** to be employed which is not directly equipped with cooling means and is therefore very simple and economical as compared to a more complex and expensive cooled burner.

The positioning and orientation assembly 13 includes a connecting flange **25*a* for removable installation of the burner body 14, the flange 25*a* cooperating with a mating connecting flange 25*b* on the burner body 14**.

In this case the burner body 14 is of a type working with parallel currents and comprises three coaxial conduits, namely a circular conduit 26 to feed a combustible substance and two conduits 27–28 to feed an oxidizing substance respectively.

Each of the conduits 26–27–28 comprises a feed intake connected respectively to circuits (not shown) supplying a combustible substance, which is generally methane or another suitable combustible gas, and a combustion-supporting substance which is generally oxygen or air under pressure.

The feeder conduits 26–27–28 feed in an independent and separate manner the respective delivery conduits within a mixing head 45 of the rotary burner 10 according to the invention.

Figure 9:
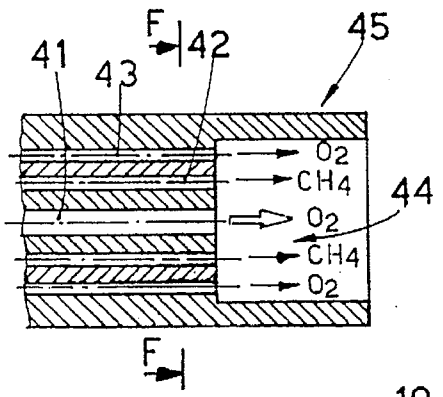
FIG. 9 is a a diagram of the mixing head of the burner according to the invention.

In particular, the mixing head 45 (FIG. 9) contains a central pipe 41 to deliver the oxidizer, a first outer annular conduit 42 to deliver a combustible substance and a second outermost annular conduit 43 to deliver the oxidizer.

The pipe 41 and the conduits 42–43 are concentric and face with their ends into a pre-combustion chamber 44.

According to a preferred embodiment of the invention the two flows of oxidizer contain the same concentration of oxygen, thereby making extremely simple and economical the system for regulating and controlling the gaseous flow to the mixing head 45.

The pre-combustion chamber 44 ends at the outlet 29 of the rotary burner 10, this outlet 29 facing the inside of the furnace.

The inclusion of the second outermost annular conduit 43 that delivers the oxidizer causes the flame generated in the pre-combustion chamber 44 to be surrounded and enclosed by a ring of oxidizer, which prevents the combustible gaseous substance from being dispersed in the environment and compels the combustible substance to become fully combined with the oxidizer. This leads to an improvement of the efficiency of the combustion of the burner 10.

Moreover, the central pipe 41 and the second outermost annular conduit 43 are able to ensure in a desired manner the release of a quantity of oxidizer in excess of that required for the flame of the rotary burner; this excess quantity can be released in the furnace and can combine with molecules of CO contained in the furnace atmosphere or in the slag layer of the bath so as to form $CO_2$, thus releasing energy in a thermal form.

Furthermore, the two flows of excess oxygen could have different velocities, from low subsonic to supersonic and are therefore capable of introducing simultaneously oxygen in the areas near to, and far away from, the burner, thus covering a bigger volume of the furnace and increasing the oxidation capability required to release the thermal energy inside the furnace.

The combustion-supporting oxidizer and the combustible substance combine in the pre-combustion chamber 44 and produce the flame within the rotary burner 10.

Figure 13:
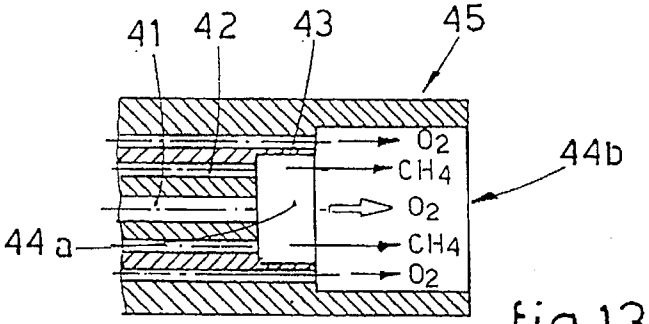
FIG. 13 shows another variant of FIG. 9.

According to the variant shown in FIG. 13 the mixing head 45 includes a first pre-combustion chamber 44*a*, into which there face respectively the central pipe 41 delivering oxidizer and the first outer annular conduit 42 delivering the combustible substance.

Within the first pre-combustion chamber 44*a* is generated the flame which then spreads into the second pre-combustion chamber 44*b*, into which the second outermost annular conduit 43 delivering oxidizer faces.

In this second pre-combustion chamber 44*b* the flame is surrounded by a ring of oxidizer, which forces any dispersed and uncombined combustible substance against the flame, thus improving the efficiency of the rotary burner 10.

Figure 10:
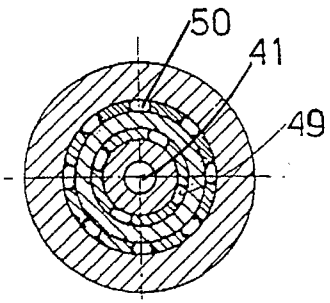
FIG. 10 shows a section along the line F—F of FIG. 9.

In a first embodiment of the invention shown in FIG. 10 the first outer annular conduit 42 delivering the combustible substance and the second outermost annular conduit 43 delivering oxidizer face into the pre-combustion chamber 44 with a series of holes, 49 and 50 respectively, which are advantageously distributed symmetrically on the circumference.

Figure 11:
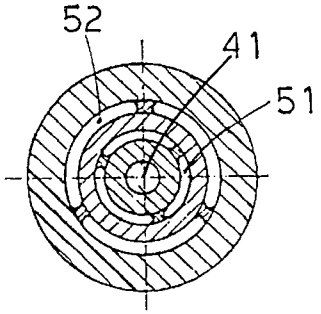
FIG. 11 shows a variant of FIG. 10.

According to the variant shown in FIG. 11 the conduits 42 and 43 face into the pre-combustion chamber 44 with apertures formed as arcs of a circumference and referenced respectively with 51 and 52.

Figure 12A:
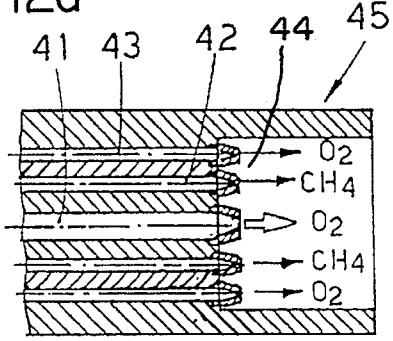
FIG. 12*a* shows a variant of FIG. 9.
Figure 12B:
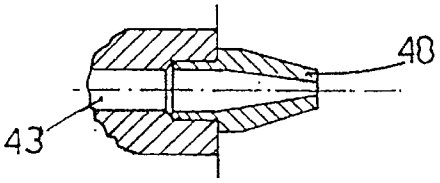
FIG. 12*b* shows an enlarged view of the terminal nozzle of the delivery conduit of FIG. 12*a;*

According to a further variant shown in FIGS. 12*a* and 12*b* the delivery pipe 41 and both the two delivery conduits 42–43 bear terminal nozzles 48, which enable an accurate and correct dosage and velocity of the gaseous substances introduced to be ensured according to the desired stoichiometric quantities and also a correct distribution of any excess of oxidizer, if required by the process.

In the rotary burner 10 according to the invention the rotation of the positioning and orientation assembly 13 about its axis 33 is achieved by means of a drive assembly 15 comprising a first actuator 30*a*, one end 31*a* of which is fitted so as to be able to oscillate about a pivot 32 included in the supporting and fixture assembly 12, while its other end 31*b* cooperates with the positioning and orientation assembly 13.

Figure 2:
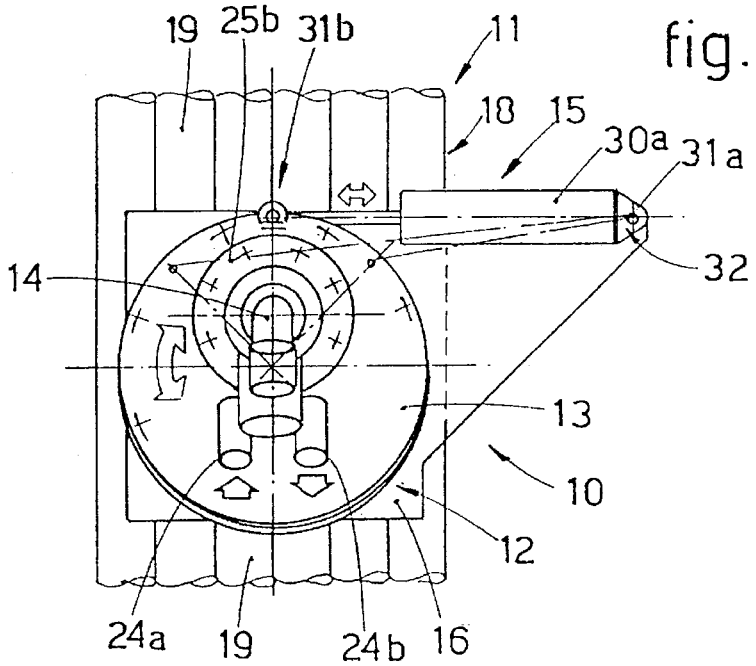
FIG. 2 is an external side view of the rotary burner of FIG. 1 according to the arrow A.

The first actuator 30*a* is shown in FIG. 2 as having the form of a hydraulic jack.

Figure 14:
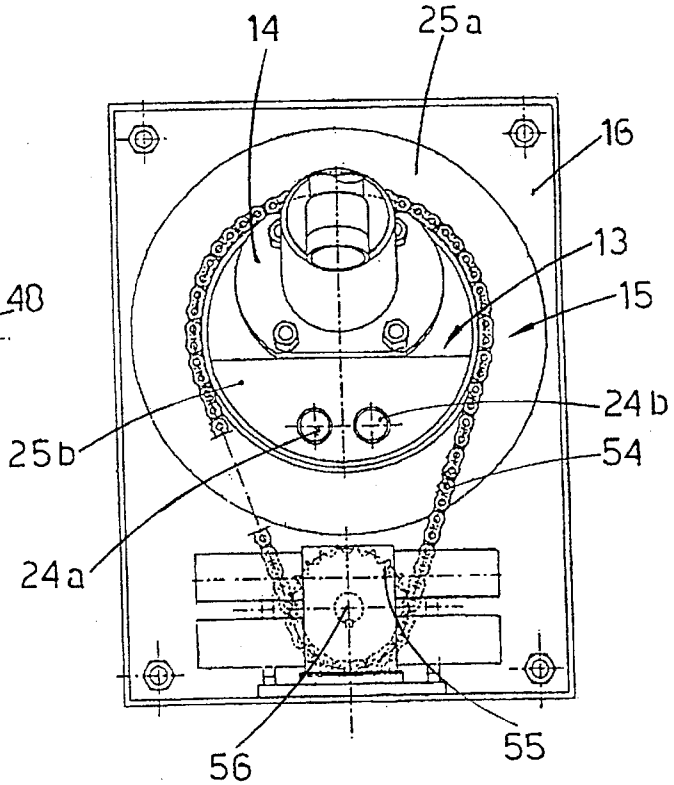
FIG. 14 shows a variant of FIG. 2.

According to the variant shown in FIG. 14 the drive assembly 15 comprises a chain 54 that transmits alternating motion from a sprocket wheel 55 associated with a drive shaft 50 to the flange 25*b* to which the burner body 14 is solidly fitted.

Other types of actuators, such as an electric, hydraulic or pneumatic motor or other types, can be used equally well within the scope of the invention.

According to another variant one single actuator can carry out the orientation of the rotary burner 10 and the change of the axis 33 of the positioning and orientation assembly 13.

If the first actuator 30*a* or sprocket wheel 55 is operated in one direction or the other, the positioning and orientation assembly 13 is rotated clockwise or anticlockwise and causes the flame leaving the burner body 14 to travel about a fraction of the conoid of revolution so as to lap a great area of the material to be heated.

Figure 8:
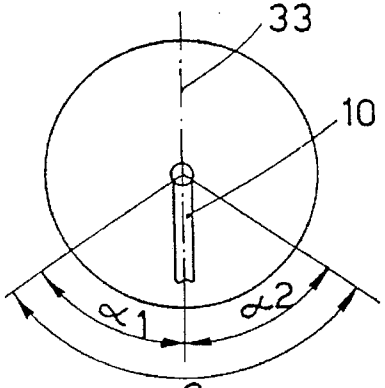
FIG. 8 is a a diagram of the working of the burner according to the invention.

According to the invention the angle of rotation, referenced with "ρ" in FIGS. 5 and 8, of the positioning and orientation assembly 13 can reach values ranging from about ±15° to about ±180°, but advantageously between ±30° and ±90°.

According to a variant the two angles defined on one side and on the other side of the axis of rotation 33 respectively and referenced with "α1" and "α2" in FIG. 8, can be different from each other where necessary to suit special processing requirements.

According to a variant the rotation of the positioning and orientation assembly 13 can be carried out continuously with an angle "ρ" of 360°.

Figure 6:
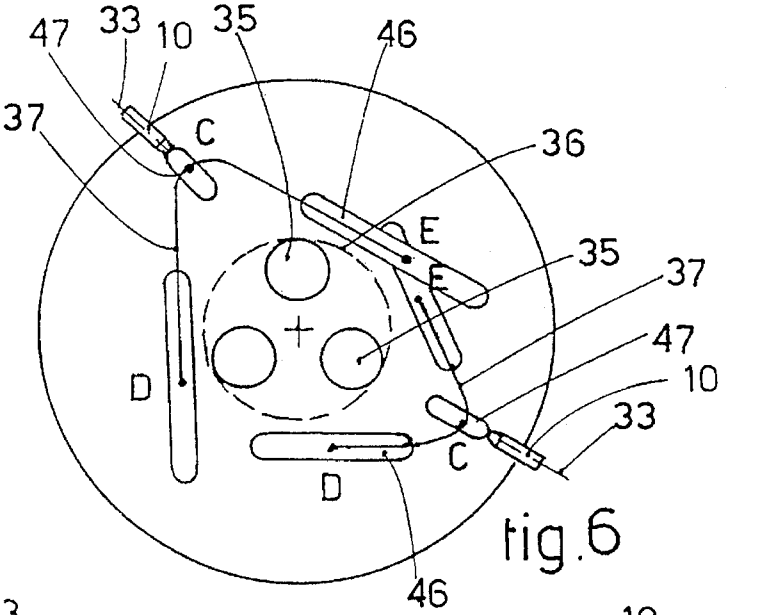
FIGS. 6 and 7 show two possible methods of use of the burner according to the invention as applied to an electric arc furnace.
Figure 7:
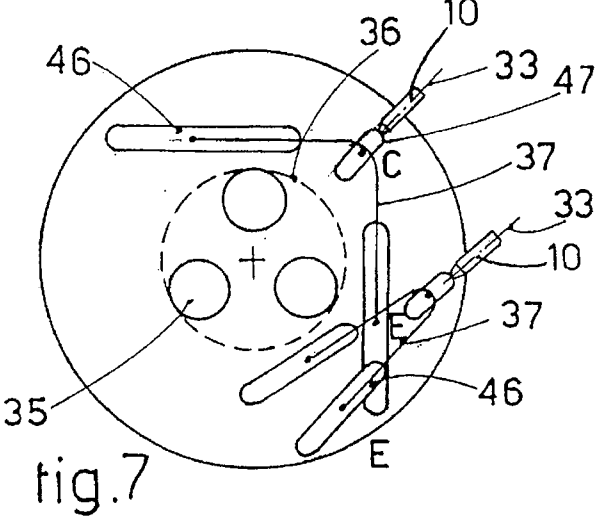

FIGS. 6 and 7 show diagrammatic examples of two possible methods of working of the rotary burner 10 according to the invention when fitted to an electric arc furnace. Three electrodes of the furnace are referenced with 35.

In the example of FIG. 6 the axis 33 of rotation of the positioning and orientation assembly 13 runs substantially towards an electrode 35.

The conoid of revolution described by the rotary burner 10 during its working causes the flame to follow a trajectory 37 which is never directed against the electrode 35 but is always external to an imaginary circumference 36 formed by the electrodes 35.

In this case the trajectory 37 followed by the flame includes two extreme points, D and E respectively, outside the imaginary circumference 36 and an intermediate transit point C; the points D and E represent substantially the limits of the trajectory 37.

FIGS. 6 and 7 show also the dispersion 46 of the flame at the limit points D and E and the concentration 47 of the flame at the point C.

The dispersion 46 of the flame at the extreme lateral points D and E of the trajectory 37 enables the flame to lap a great mass of charge in the zone outside the imaginary circumference 38 formed by the electrodes 35.

With this type of working the flame does not strike the electrodes 35 directly, for such striking could be dangerous for the structure and for the life and working performance of the electrodes 35.

Moreover, the flame, by lapping the area outside the circumference 36 formed by the electrodes 35, contributes to the movement of rotary stirring of the bath caused by the sequence of the phases in the supply of current to the electrodes 35.

Furthermore, the flame of the rotary burner 10 laps the scrap in the coldest areas of the furnace; these areas have a greater requirement of an auxiliary contribution of heat than the other areas of the furnace.

FIG. 7 shows diagrammatically another possible method of working of the rotary burners 10, which in this example have the axis of rotation 33 of the relative positioning and orientation assembly 13 not directed towards one of the electrodes 35. The trajectory 37 followed by the flame is always outside the imaginary circumference 36 formed by the electrodes 35. and laps the cold areas of the furnace.

According to the invention at least the panel 18 above the rotary burner 10 has its lower end 18*a* partly jutting out into the furnace to protect the rotary burner 10 especially during the steps of charging the furnace.

Moreover, for the reasons detailed above, this lower end 18*a* protects also the interface of rotation between the movable and stationary parts (16–21) against the liquid slag flowing down along the cooled panels 18 during the overheating and refining steps of the melting process.

We claim:

1. Rotary burner suitable for installation on a sidewall of a furnace and for cooperating with the inside of the furnace, which comprises at least one sidewall equipped with cooled panels, the rotary burner including at least one supporting and fixture assembly solidly associated with the sidewall of the furnace and at least one positioning and orientation assembly rotatably fitted on the axis of the supporting and fixture assembly, the positioning and orientation assembly containing a through hole in which the body of the rotary burner is removably secured in a retracted position, the through hole having its axis downwardly inclined towards the inside of the furnace by an angle "β" between 10° and 60° in relation to the axis of rotation of the positioning and orientation assembly, the positioning and orientation assembly being able to be rotated by at least an arc of a circumference up to ±180° by the action of a drive assembly, the cooled panel including above the rotary burner at least one projection facing towards the inside of the furnace so as to provide protection.

2. Rotary burner as in claim 1, which includes a mixing head equipped with a pre-combustion chamber, into which there face respectively a central pipe to deliver oxidizer, a first outer annular conduit to deliver a combustible substance and a second outermost annular conduit to deliver oxidizer, the pipe and the conduits being substantially concentric.

3. Rotary burner as in claim 2, in which the pre-combustion chamber is defined by a first pre-combustion chamber, into which there face at least the central pipe delivering oxidizer and the first outer annular conduit delivering combustible substance, and by a second pre-combustion chamber), which faces towards the inside of the furnace and into which there faces at least the second outermost annular conduit delivering oxidizer.

4. Rotary burner (10) as in claim 2, in which at least the first outer annular conduit (42) delivering combustible substance and the second outermost annular conduit (43) delivering oxidizer include terminal apertures formed as holes.

5. Rotary burner as in claim 2, in which at least the first outer annular conduit delivering combustible substance and the second outermost annular conduit delivering oxidizer include terminal apertures formed as an arc of a circle.

6. Rotary burner as in claim 2, in which the central pipe and the second outermost annular conduit delivering oxidizer and the first outer annular conduit delivering combustible substance include terminal nozzles.

7. Rotary burner as in claim 1, in which the axis of rotation of the positioning and orientation assembly is stationary and lies on a horizontal plane.

8. Rotary burner as in claim 1, in which the axis of rotation of the positioning and orientation assembly is stationary and is inclined in relation to the horizontal plane.

9. Rotary burner as in claim 1, in which the positioning and orientation assembly is associated with an assembly to orient and change the axis thereof, so that that axis of rotation of the positioning and orientation assembly can be positioned in a desired, controlled manner.

10. Rotary burner as in claim 1, in which the axis of rotation of the positioning and orientation assembly is inclined towards the right or left in relation to the radial vertical plane of the furnace.

11. Rotary burner as in claim 1, in which the burner body lies in the first frontal segment of the through hole.

12. Rotary burner as in claim 1, in which at least the positioning and orientation assembly contains at least one cooling chamber.

13. Rotary burner as in claim 1, in which the positioning and orientation assembly can be rotated continuously by an arc of a circumference of 360°.

14. Rotary burner as in claim 1, in which the drive assembly comprises at least a first actuator fitted to the supporting and fixture assembly and cooperating with the positioning and orientation assembly.

15. Rotary burner as in claim 14, in which the drive assembly comprises a second actuator fitted to the supporting and fixture assembly and cooperating with the assembly that orients and changes the axis of the positioning and orientation assembly.

16. Rotary burner as in claim 1, in which the trajectory followed by the flame generated by the rotary burner during rotation of the burner is always external to an imaginary circumference formed by the electrodes and lies between that imaginary circumference and the sill line of the furnace.

17. Rotary burner as in claim 1, in which the axis of rotation of the positioning and orientation assembly is directed towards an electrode.

18. Rotary burner as in claim 1, in which the axis of rotation of the positioning and orientation assembly is not directed towards an electrode.

* * * * *